US008668321B2

(12) United States Patent
Kojima et al.

(10) Patent No.: US 8,668,321 B2
(45) **Date of Patent: *Mar. 11, 2014**

(54) INK JET RECORDING METHOD AND INK JET RECORDING APPARATUS

(75) Inventors: Yojiro Kojima, Tokyo (JP); Yukako Tamanuki, Tokyo (JP); Shogo Takemoto, Yokohama (JP); Satoshi Kudo, Kawasaki (JP); Yoshio Kinoshita, Tachikawa (JP); Kumiko Mafune, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 297 days.

This patent is subject to a terminal disclaimer.

(21) Appl. No.: 13/165,098

(22) Filed: Jun. 21, 2011

(65) Prior Publication Data

US 2011/0310202 A1 Dec. 22, 2011

(30) Foreign Application Priority Data

Jun. 22, 2010 (JP) ..... 2010-141940

(51) Int. Cl.
*B41J 2/01* (2006.01)

(52) U.S. Cl.
USPC ..... 347/100; 347/95; 347/19

(58) Field of Classification Search
USPC ..... 347/95–100, 19; 523/160, 161; 106/31.13, 31.27, 31.46–31.48
See application file for complete search history.

(56) References Cited

U.S. PATENT DOCUMENTS

| | | | | |
|---|---|---|---|---|
| 7,419,537 | B2 * | 9/2008 | Fujii et al. | 106/31.47 |
| 7,591,888 | B2 * | 9/2009 | Fujii et al. | 106/31.47 |
| 8,328,346 | B2 * | 12/2012 | Kudo et al. | 347/100 |
| 2007/0285456 | A1 * | 12/2007 | Takasu et al. | 347/19 |
| 2008/0274286 | A1 * | 11/2008 | Yamashita et al. | 427/256 |
| 2009/0047430 | A1 * | 2/2009 | Mori et al. | 427/256 |
| 2009/0095199 | A1 * | 4/2009 | Aikawa et al. | 106/31.47 |
| 2011/0310162 | A1 * | 12/2011 | Tamanuki et al. | 347/20 |

FOREIGN PATENT DOCUMENTS

| | | | |
|---|---|---|---|
| JP | 11-268256 | A | 10/1999 |
| WO | 2004/087815 | A1 | 10/2004 |
| WO | 2007/091631 | A1 | 8/2007 |

* cited by examiner

*Primary Examiner* — Matthew Luu
*Assistant Examiner* — Rut Patel
(74) *Attorney, Agent, or Firm* — Canon U.S.A., Inc., IP Division

(57) ABSTRACT

An ink jet recording method includes an image formation step of forming an image on a recording medium having an ink-receiving layer by ejecting an ink from an ink jet recording head and a humidification step of humidifying a gap between the recording head and the recording medium, in which in the image formation step, an ink containing a specified dye represented by general formula (I) and a water-soluble organic compound having an inorganic-organic balance value of 1.4 or more to 2.7 or less is used.

7 Claims, 1 Drawing Sheet

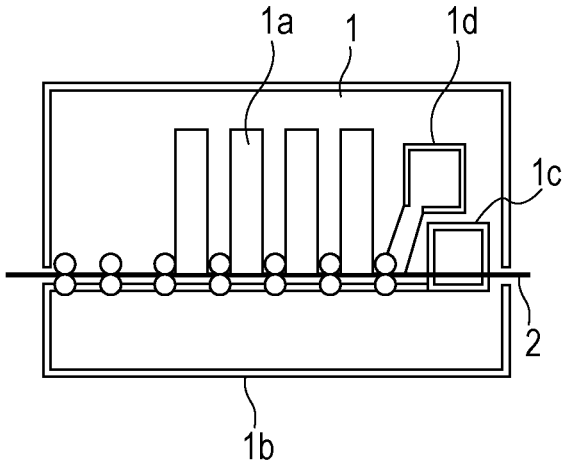
1a
1
1d
1c
2
1b

INK JET RECORDING METHOD AND INK JET RECORDING APPARATUS

BACKGROUND OF THE INVENTION

1. Field of the Invention

The present invention relates to an ink jet recording method and an ink jet recording apparatus.

2. Description of the Related Art

The output form of an image has rapidly shifted from a silver halide process to an ink jet process because of an increase in the quality of an image formed by an ink jet recording method. Under such circumstances, an image is required to have higher fastness properties, such as ozone resistance. For example, International Publication No. WO2004/087815 discloses that the use of a phthalocyanine dye having a specific substituent achieves high ozone resistance. Furthermore, International Publication No. WO2007/091631 discloses that excellent ozone resistance is achieved by the use of an azaphthalocyanine dye, in which outer aromatic rings of a phthalocyanine skeleton are nitrogen-containing heteroaromatic rings.

To achieve higher quality of an image in an ink jet recording method, there have been advances in the minimization of an ink droplet. An increase in the ejection stability of ink has also been required. To improve the reliability, for example, Japanese Patent Laid-Open No. 11-268256 discloses a recording method by which recording can be performed even on a material with low affinity to ink and which suppresses scattering of water from ink droplets and clogging of a recording head by humidifying a gap between a recording head and a recording medium.

SUMMARY OF THE INVENTION

The inventors have conducted intensive studies and have found that the use of the azaphthalocyanine dye described in International Publication No. WO2007/091631 improves the ozone resistance of an image formed on a recording medium having an ink-receiving layer. However, in the case where an image is formed with ink containing the dye by an ink jet recording method including a humidification step, feathering is liable to occur. Furthermore, the degree of feathering is inferior to that of a phthalocyanine dye described in International Publication No. WO2004/087815. Feathering indicates a blur of an image formed using an ink and is disadvantageous when a high-definition image is formed.

Accordingly, aspects of the present invention provide an ink jet recording method capable of forming an image that suppresses the occurrence of feathering even if a gap between a recording head and a recording medium is humidified to improve the ejection stability of ink. Furthermore, aspects of the present invention provide an ink jet recording apparatus that provides the foregoing beneficial effects.

According to one aspect of the present invention, an ink jet recording method includes:

an image formation step of forming an image on a recording medium having an ink-receiving layer by ejecting an ink from an ink jet recording head; and a humidification step of humidifying a gap between the recording head and the recording medium, wherein in the image formation step, an ink containing a dye represented by general formula (I) and a water-soluble organic compound having an inorganic-organic balance value of 1.4 or more to 2.7 or less is used:

general formula (I)

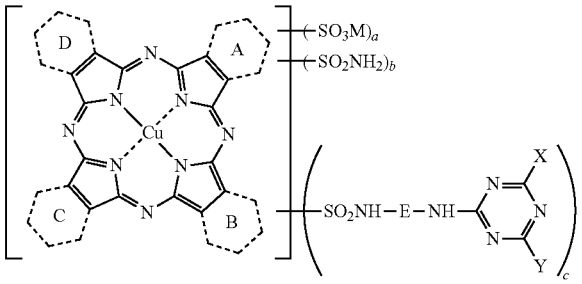

wherein in general formula (I), A, B, C, and D each independently represent a six-membered ring having aromaticity, and at least one of A, B, C, and D represents a pyridine ring or a pyrazine ring; M's each independently represent a hydrogen atom, an alkali metal, ammonium, or organic ammonium; E represents an alkylene group; X represents a sulfo-substituted anilino group, a carboxy-substituted anilino group, or a phosphono-substituted anilino group, and the substituted anilino group may further contain one to four substituents of at least one type of substituent selected from the group consisting of a sulfonic acid group, a carboxy group, a phosphono group, a sulfamoyl group, a carbamoyl group, a hydroxy group, an alkoxy group, an amino group, an alkylamino group, a dialkylamino group, an arylamino group, a diarylamino group, an acetylamino group, an ureido group, an alkyl group, a nitro group, a cyano group, a halogen atom, an alkylsulfonyl group, and an alkylthio group; Y represents a hydroxy group or an amino group; and a, b, and c satisfy $0 \le a \le 2.0$, $0 \le b \le 3.0$, and $0.1 \le c \le 3.0$, provided that $a+b+c=1.0$ to 4.0.

Further features of the present invention will become apparent from the following description of exemplary embodiments with reference to the attached drawing.

BRIEF DESCRIPTION OF THE DRAWING

FIGURE is a schematic diagram of the main portion of an ink jet recording apparatus according to aspects of the present invention.

DESCRIPTION OF THE EMBODIMENTS

Embodiments of the present invention will be described below in detail. Hereinafter, a dye represented by general formula (I) is also referred to as a dye of general formula (I).

The inventors have found that in the case of forming an image on a recording medium including an ink-receiving layer using an ink that contains the dye of general formula (I) and a specified water-soluble organic compound, the humidification of a gap between a recording head and a recording medium suppresses the occurrence of feathering. That is, contrary to our expectations, the occurrence of feathering of an image is suppressed by performing humidification, compared with the case where humidification is not performed at the time of image formation. It has also been found that in the case of using an ink containing a dye which has a copper phthalocyanine skeleton but which is different from the dye represented by general formula (I), if humidification is performed, the occurrence of feathering is noticeable, compared with the case where humidification is not performed.

The inventors have conducted studies on the cause of the difference described above and have concluded that the cause is attributed to a phenomenon described below. When the gap between the recording head and the recording medium is humidified, the ink-receiving layer of the recording medium absorbs water, so that the amount of water in the ink-receiving layer is increased, compared with the case where humidification is not performed. In the case where an image is formed on the recording medium in such a state using an ink, the ink is less likely to penetrate because of the increased amount of water in the ink-receiving layer, compared with the case where humidification is not performed. Here, a general dye diffuses via water in the ink-receiving layer while the absorption of the ink is inhibited, extending the range in which the dye is fixed. Thereby, feathering occurs.

The dye of general formula (I) has a unique property in that when the dye is present in ink together with the specified water-soluble organic compound, the aggregability and nondiffusivity of the dye are increased. In the case of using the dye of general formula (I) serving as a coloring material of ink, it is believed that the dye does not diffuse via water in the ink-receiving layer but adsorbs preferentially on the ink-receiving layer because of the property while the absorption of the ink is inhibited by humidification. The fact that the dye adsorbs on the ink-receiving layer while the absorption of the ink is inhibited indicates that the dye adsorbs on a narrow range (not diffused) compared with the range of the ink-receiving layer on which the dye adsorbs in a state in which the absorption of the ink is not inhibited without humidification. In this way, the occurrence of feathering is suppressed to some extent.

Here, the inventors believe that the reason the dye of general formula (I) provides high aggregability and nondiffusivity when the dye is present in ink together with the specified water-soluble organic compound is that the dye has an azaphthalocyanine structure. A difference between a common phthalocyanine and azaphthalocyanine is that at least one of outer aromatic rings of the phthalocyanine skeleton is a nitrogen-containing heteroaromatic ring. The nitrogen atom of the nitrogen-containing heteroaromatic ring has a lone pair of electrons and thus interacts electrically with a hydrogen atom or the like. So, an azaphthalocyanine molecule is more likely to interact with another azaphthalocyanine molecule than water molecules when the specified water-soluble organic compound is present together with azaphthalocyanine in ink, thereby increasing the aggregability and nondiffusivity.

Furthermore, in the case of performing humidification, advantages due to the aggregability and nondiffusivity of the dye of general formula (I) are intensified by the presence of the specified water-soluble organic compound together with the dye in ink. The water-soluble organic compound will be described below in detail. Humidification and the use of an ink containing a water-soluble organic compound that has low solubility in (affinity for) the dye of general formula (I) significantly suppresses the occurrence of feathering.

Ink Jet Recording Method

An aspect of the present invention is characterized by including an image formation step of forming an image on a recording medium having an ink-receiving layer using the specified ink described above and a humidification step of humidifying a gap between a recording head and a recording medium.

Image Formation Step

In aspects of the present invention, the image formation step of ejecting an ink from an ink jet recording head to form an image on a recording medium having an ink-receiving layer is performed. In the image formation step, an ink containing the dye of general formula (I) and a water-soluble organic compound having an inorganic-organic balance (IOB) value of 1.4 or more to 2.7 or less is used. An exemplary method for ejecting an ink includes applying thermal energy or mechanical energy to the ink. In aspects of the present invention, a method for ejecting an ink by the application of thermal energy can be employed.

Recording Medium

The recording medium used in aspects of the present invention may have an ink-receiving layer and can have a glossy surface or a semi-glossy surface. Specifically, the recording medium can have an ink-receiving layer on at least one surface of a support, the ink-receiving layer mainly containing a pigment composed of, for example, silica, alumina, or its hydrate, and optionally containing an additive, for example, a binder or a cationic polymer. In aspects of the present invention, in particular, a recording medium can have an ink-receiving layer containing at least one of alumina and hydrated alumina. In the recording medium, ink is absorbed by pores of a porous structure formed of pigment particles to form an image with high quality.

With respect to a support, a support which is capable of being provided with the ink-receiving layer and which has stiffness such that the support can be conveyed by a conveying mechanism of an ink jet recording apparatus can be used. An example of the support is paper containing pulp or a filler. A recording medium may be used in which a resin layer composed of, for example, polyolefin, is arranged on at least one surface of a support and in which an ink-receiving layer is arranged on the resin layer. Furthermore, a recording medium may be used in which ink-receiving layers are arranged on both surfaces of a support.

The recording medium used in the ink jet recording method according to aspects of the present invention may be cut into predetermined size in advance. Alternatively, the recording medium may be a wound sheet in the form of a roll, the wound sheet being to be cut into predetermined size after the formation of an image.

Ink

Coloring Material

A coloring material contained in the ink used in aspects of the present invention is the dye represented by general formula (I):

general formula (I)

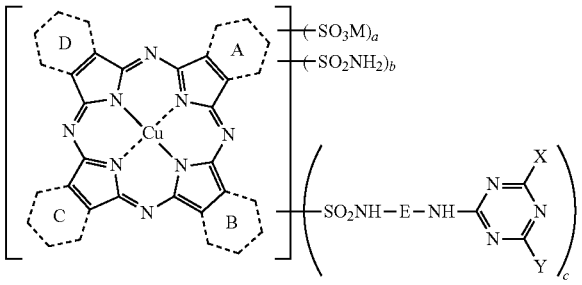

wherein in general formula (I), A, B, C, and D each independently represent an six-membered ring having aromaticity, and at least one of A, B, C, and D represents a pyridine ring or a pyrazine ring; M's each independently represent a hydrogen atom, an alkali metal, ammonium, or organic ammonium; E represents an alkylene group; X represents a sulfo-substituted anilino group, a carboxy-substituted anilino group, or a phosphono-substituted anilino group, and the substituted anilino group may further contain one to four substituents of at least one type of substituent selected from the group consisting of a sulfonic acid group, a carboxy group, a phosphono group, a sulfamoyl group, a carbamoyl group, a hydroxy group, an alkoxy group, an amino group, an alkylamino group, a dialkylamino group, an arylamino group, a diarylamino group, an acetylamino group, an ureido group, an alkyl group, a nitro group, a cyano group, a halogen atom, an alkylsulfonyl group, and an alkylthio group; Y represents a hydroxy group or an amino group; and a, b, and c satisfy $0 \leq a \leq 2.0$, $0 \leq b \leq 3.0$, and $0.1 \leq c \leq 3.0$, provided that $a+b+c=1.0$ to 4.0. In aspects of the present invention, the content (% by mass) of the dye represented by general formula (I) in the ink may be in the range of 0.1% by mass or more to 10.0% by mass or less, such as 0.7% by mass or more to 2.0% by mass or less with respect to the total mass of the ink. A content of less than 0.1% by mass can lead to an image having insufficient ozone resistance. A content of more than 10.0% by mass can lead to insufficient ejection stability of the ink.

In general formula (I), A, B, C, and D each independently represent a six-membered ring having aromaticity, and at least one of A, B, C, and D represents a pyridine ring or a pyrazine ring. Examples of the six-membered ring having aromaticity include a benzene ring, a pyridine ring, and a pyrazine ring. Among these rings, a pyridine ring can be used. In aspects of the present invention, a dye can be used in which one to three of A, B, C, and D is pyridine rings or pyrazine rings and in which the remainder is a benzene ring.

In general formula (I), E represents an alkylene group. The number of carbon atoms in the alkylene group is may be in the range of 2 to 12, such as 2 to 6. Specific examples of the alkylene group include an ethylene group, a propylene group, a butylene group, a pentylene group, a hexylene group, a cyclopropylenediyl group, a 1,2- or 1,3-cyclopentylenediyl group, and a 1,2-, 1,3-, or 1,4-cyclohexylene group. Among these groups, an ethylene group, a propylene group, and a butylene group can be used.

In general formula (I), X represents a sulfo-substituted anilino group, a carboxy-substituted anilino group, or a phosphono-substituted anilino group. The substituted anilino group may further contain zero to four substituents and even zero to two of at least one type of substituent selected from the group consisting of a sulfonic acid group, a carboxy group, a phosphono group, a sulfamoyl group, a carbamoyl group, a hydroxy group, an alkoxy group, an amino group, an alkylamino group, a dialkylamino group, an arylamino group, a diarylamino group, an acetylamino group, an ureido group, an alkyl group, a nitro group, a cyano group, a halogen atom, an alkylsulfonyl group, and an alkylthio group. Specific examples of X include a 2,5-disulfoanilino group, a 2-sulfoanilino group, a 3-sulfoanilino group, a 4-sulfoanilino group, a 2-carboxyanilino group, a 4-ethoxy-2-sulfoanilino group, a 2-methyl-5-sulfoanilino group, a 2-methoxy-4-nitro-5-sulfoanilino group, a 2-chloro-5-sulfoanilino group, a 3-carboxy-4-hydroxyanilino group, a 3-carboxy-4-hydroxy-5-sulfoanilino group, a 2-hydroxy-5-nitro-3-sulfoanilino group, 4-acetylamino-2-sulfoanilino group, a 4-anilino-3-sulfoanilino group, a 3,5-dicarboxyanilino group, a 2-carboxy-4-sulfamoylanilino group, a 2,5-dichloro-4-sulfoanilino group, and a 3-phosphonoanilino group. In general formula (I), Y represents a hydroxy group or an amino group.

In general formula (I), for example, a sulfonic acid group, a carboxy group, and a phosphono group may be in the form of a salt. Examples of a counter ion that can form a salt include ions of alkali metals, ammonium ions, and organic ammonium ions. Examples of the alkali metal include lithium, sodium, and potassium. Examples of the organic ammonium include alkylamines having 1 to 3 carbon atoms, such as methylamine and ethylamine; and onium salts of mono-, di-, or tri-alkanolamine having 1 to 4 carbon atoms, such as monoethanolamine, diethanolamine, triethanolamine, monoisopropanolamine, diisopropanolamine, and triisopropanolamine. An alkali-earth metal, for example, calcium or magnesium, may be used as the counter ion.

Specific examples of the dye of general formula (I) include exemplified compounds I-1 to I-24 shown in Table 1. Table 1 shows groups of A, B, C, D, E, X, and Y in general formula (I). The dye according to aspects of the present invention is not limited to the exemplified compounds described below as long as it has a structure included in the structure of general formula (I) and it is included in the definition of general formula (I). Because at least one of A, B, C, and D in general formula (I) is a pyridine ring or a pyrazine ring, regioisomers with respect to the position of the nitrogen atom are present. So, in the case of synthesizing a compound, a mixture of these regioisomers is obtained. It is difficult to isolate these isomers. Furthermore, it is difficult to identify these isomers by analysis. Thus, the dye of general formula (I) is usually used as a mixture. However, even when the dye contains these isomers, the advantageous effects of aspects of the present invention are obtained without change. So, in this specification, these isomers are not distinguished. With respect to A, B, C, and D in general formula (I) according to aspects of the present invention, the number of pyridine rings may be in the range of 1 to 3 and even 1 to 2. Specifically, among the exemplified compounds, exemplified compounds I-1 to I-3, I-10 to I-12, and I-21 to I-23.

TABLE 1

Exemplified dye compound represented by general formula (I)

| Exemplified compound | A | B | C | D | E | X | Y | a | b | c |
|---|---|---|---|---|---|---|---|---|---|---|
| I-1 | 2,3-PD | Bz | Bz | Bz | Et | 2,5-disulfoanilino | $NH_2$ | 0 | 2 | 1 |
| I-2 | 2,3-PD | 2,3-PD | Bz | Bz | Et | 2,5-disulfoanilino | $NH_2$ | 0 | 1 | 1 |
| I-3 | 2,3-PD | Bz | 2,3-PD | Bz | Et | 2,5-disulfoanilino | $NH_2$ | 0 | 1 | 1 |
| I-4 | 2,3-PD | 2,3-PD | 2,3-PD | Bz | Et | 2,5-disulfoanilino | $NH_2$ | 0 | 0 | 1 |
| I-5 | 2,3-PD | Bz | Bz | Bz | Et | 4-sulfoanilino | $NH_2$ | 0 | 2 | 1 |
| I-6 | 2,3-PD | Bz | Bz | Bz | Et | 2,5-disulfoanilino | OH | 0 | 2 | 1 |
| I-7 | 2,3-PD | Bz | Bz | Bz | Et | 3,5-dicarboxyanilino | $NH_2$ | 0 | 2 | 1 |
| I-8 | 2,3-PD | Bz | Bz | Bz | Pr | 2,5-disulfoanilino | $NH_2$ | 0 | 2 | 1 |
| I-9 | 2,3-PD | Bz | Bz | Bz | Et | 2-carboxy-4-sulfoanilino | $NH_2$ | 0 | 2 | 1 |
| I-10 | 2,3-PZ | Bz | Bz | Bz | Et | 2,5-disulfoanilino | $NH_2$ | 0 | 2 | 1 |
| I-11 | 2,3-PZ | 2,3-PZ | Bz | Bz | Et | 2,5-disulfoanilino | $NH_2$ | 0 | 1 | 1 |
| I-12 | 2,3-PZ | Bz | 2,3-PZ | Bz | Et | 2,5-disulfoanilino | $NH_2$ | 0 | 1 | 1 |
| I-13 | 2,3-PZ | 2,3-PZ | 2,3-PZ | Bz | Et | 2,5-disulfoanilino | $NH_2$ | 0 | 0 | 1 |
| I-14 | 2,3-PD | Bz | Bz | Bz | Et | 2-methoxy-5-sulfoanilino | $NH_2$ | 0 | 2 | 1 |

TABLE 1-continued

| Exemplified compound | A | B | C | D | E | X | Y | a | b | c |
|---|---|---|---|---|---|---|---|---|---|---|
| Exemplified dye compound represented by general formula (I) | | | | | | | | | | |
| I-15 | 2,3-PD | Bz | Bz | Bz | Et | 2-nitro-4-sulfoanilino | $NH_2$ | 0 | 2 | 1 |
| I-16 | 2,3-PD | Bz | Bz | Bz | Et | 2,5-dichloro-4-sulfoanilino | $NH_2$ | 0 | 2 | 1 |
| I-17 | 2,3-PD | Bz | Bz | Bz | Bt | 2,5-disulfoanilino | $NH_2$ | 0 | 2 | 1 |
| I-18 | 2,3-PD | Bz | Bz | Bz | Et | 3-carboxy-4-hydroxy-5-sulfoanilino | $NH_2$ | 0 | 2 | 1 |
| I-19 | 2,3-PD | Bz | Bz | Bz | Et | 2-sulfoanilino | OH | 0 | 2 | 1 |
| I-20 | 2,3-PD | Bz | Bz | Bz | Et | 3-sulfoanilino | OH | 0 | 2 | 1 |
| I-21 | 3,4-PD | Bz | Bz | Bz | Et | 2,5-disulfoanilino | $NH_2$ | 0 | 2 | 1 |
| I-22 | 3,4-PD | 3,4-PD | Bz | Bz | Et | 2,5-disulfoanilino | $NH_2$ | 0 | 1 | 1 |
| I-23 | 3,4-PD | Bz | 3,4-PD | Bz | Et | 2,5-disulfoanilino | $NH_2$ | 0 | 1 | 1 |
| I-24 | 3,4-PD | 3,4-PD | 3,4-PD | Bz | Et | 2,5-disulfoanilino | $NH_2$ | 0 | 0 | 1 |

2,3-PD: 2,3-pyrido
2,3-PZ: 2,3-pyrazino
Bz: benzo
Et: ethylene
Pr: propylene
Bt: butylene Water-Soluble Organic Compound Having IOB Value of 1.4 or More to 2.7 or Less The inventors have paid attention to the ratio of an inorganic value and an organic value, i.e., an inorganic-organic balance (IOB, inorganic value/organic value), based on the theory of an organic conceptual diagram, the IOB value serving as an index of the properties of an organic compound. The organic conceptual diagram is a diagram in which properties of an organic compound are divided into the organic value that indicates covalency and the inorganic value that indicates ionicity and in which they are plotted on rectangular coordinates with the organic axis (horizontal axis) and the inorganic axis (vertical axis). The organic value is substantially equal to the product of the number of carbon atoms of a compound and 20. The inorganic value is defined as the sum of inorganic values intrinsic to groups.

In reference 1 (Yosio Koda. "Yuki Gainen Zu-Kiso to Oyo-" ("Organic Conceptual Diagram, Foundation and Application"); Sankyo Shuppan, 1984), the inorganic values of about 80 groups are determined to date; for example, the inorganic value of a hydroxy group is defined as 100. Reference 2 (Ryohei Oda. "Teijin Taimusu" ("Teijin Times"), 22(9), 10-4 (1952)) describes the following: The organic nature in the organic conceptual diagram corresponds to the lipophilicity (i.e., hydrophobicity) of a surfactant. So, the ratio of the inorganic nature to the organic nature calculated on the basis of the chemical structure of a surfactant has the same meaning as the hydrophile-lipophile balance (HLB) of the surfactant. Conversely, the IOB value can be regarded as an index that indicates the hydrophobicity of an organic compound.

The inventors have conducted studies and have found that the use of the water-soluble organic compound that is less likely to dissolve the dye of general formula (I) increases the aggregability and nondiffusivity of the dye of general formula (I) in the ink-receiving layer of the recording medium, thereby suppressing the occurrence of feathering. As described above, the degree of hydrophobicity of the water-soluble organic compound can be determined by the IOB value. The inventors have paid attention to the solubility of the dye of general formula (I) and have conducted studies of ranges of the IOB values of the water-soluble organic compound. Thus, the inventors have concluded that the ink needs to contain the water-soluble organic compound having an IOB value of 1.4 or more to 2.7 or less. The use of a water-soluble organic compound having an IOB value of less than 1.4 or more than 2.7 fails to suppress the occurrence of feathering. The water-soluble organic compound can have an IOB value of 1.7 or more to 2.5 or less. In aspects of the present invention, advantages of aspects of the present invention are provided as long as the ink contains the water-soluble organic compound having an IOB value of 1.4 or more to 2.7 or less. Thus, the ink may further contain a water-soluble organic compound having an IOB value of less than 1.4 or more than 2.7.

Examples of the water-soluble organic compound which has an IOB value of 1.4 or more to 2.7 or less contained in the ink used in aspects of the present invention are described below, and each of the numbers in parentheses represents the IOB value. Examples thereof include triethylene glycol (2.7), 1,4-butanediol (2.5), 1,5-pentanediol (2.0), 3-methyl-1,5-pentanediol (1.8), 1,2-hexanediol (1.7), 1,6-hexanediol (1.7), triethylene glycol monobutyl ether (1.4), and 2-pyrrolidone (1.8). They may be contained in the ink separately or in combination. In aspects of the present invention, the water-soluble organic compound is not limited to the foregoing compounds. Any water-soluble organic compound may be used without limitation as long as it has an IOB value within the range described above. In aspects of the present invention, among these water-soluble organic compounds, 1,5-pentanediol can be used.

In aspects of the present invention, letting the content of the dye represented by general formula (I) in the ink be A (% by mass), and letting the content of the water-soluble organic compound having an IOB value of 1.4 or more to 2.7 or less be B (% by mass), the following relationship can be satisfied. The content A (% by mass) of the dye represented by general formula (I) in the ink is in the range of 0.7% by mass or more to 2.0% by mass or less with respect to the total mass of the ink. In addition, the mass ratio (B/A) of the content B (% by mass) of the water-soluble organic compound having an IOB value of 1.4 or more to 2.7 or less to the content A (% by mass) of the dye represented by general formula (I) may be in the range of 4.5 times or more to 20.0 times or less and even 5.0 times or more to 14.3 times or less with respect to the total mass of the ink. A mass ratio of less than 4.5 times or more than 20.0 times can fail to strike a balance between the content of the dye and the content of the water-soluble organic compound having the specified IOB value, thereby failing to sufficiently suppressing the occurrence of feathering. In particular, a mass ratio of more than 20.0 times can lead to an excessively high content of the water-soluble organic compound having the specified IOB value, thereby increasing the viscosity of the ink and failing to sufficiently providing ejection stability.

In aspects of the present invention, our attention is focused on the affinity between the dye and the water-soluble organic compound. So, the term "the water-soluble organic compound" having an IOB value, which is determined by calculation, does not include coloring materials, such as dyes and pigments, and additives as described below.

Aqueous Medium

The ink may contain an aqueous medium, which is a mixed solvent of water and a water-soluble organic solvent, in addition to the water-soluble organic compound having an IOB value falling within the specified range. Deionized water and ion-exchanged water can be used as water. The content (% by mass) of water in the ink can be in the range of 50.0% by mass or more to 95.0% by mass or less with respect to the total mass of the ink. Examples of the water-soluble organic solvent include monohydric and polyhydric alcohols, glycols, glycol ethers, and nitrogen-containing compounds, which can be used for ink for use in ink jet printing. These compounds may be contained in the ink separately or in combination. The content (% by mass) of the water-soluble organic solvent in the ink can be in the range of 2.0% by mass or more to 50.0% by mass or less with respect to the total mass of the ink. In this case, the content of the water-soluble organic solvent includes the content of the water-soluble organic compound having an IOB value within the specific range.

Additional Additive

The ink used in aspects of the present invention may contain a solid water-soluble organic compound at room temperature, for example, urea, its derivative, or polyhydric alcohol, e.g., trimethylolpropane or trimethylolethane. Furthermore, the ink may optionally contain various additives in addition to the components described above. Examples of the additives include surfactants, pH adjusting agents, rust-preventive agents, preservatives, fungicides, antioxidants, anti-reducing agents, evaporation accelerators, chelating agents, and water-soluble polymers.

Humidification Step

An aspect of the present invention includes the foregoing image formation step and a humidification step of humidifying a gap between a recording head and a recording medium. The humidification step may be performed to the extent that the ink-receiving layer of the recording medium sufficiently absorbs water. An example of a humidification method is a method in which humidified air is fed into the gap between the recording head and the recording medium. In aspects of the present invention, the humidification step is performed by supplying humidified air into the gap between the recording head and the recording medium. The humidification step can be performed in such a manner that the gap between the recording head and the recording medium is filled with an atmosphere having a temperature of 35° C. or lower and an absolute humidity of 0.013 kg/kgDA or higher. Furthermore, the humidification step can be performed in an atmosphere having a temperature of 35° C. or lower and an absolute humidity of 0.015 kg/kgDA or higher. Here, the term "absolute humidity" used aspects of the present invention indicates an absolute humidity on a weight basis, i.e., the weight (kg) of water vapor contained in humidified air with respect to the weight (kg) of dry air as expressed by the unit kg/kgDA. The lower limit of the temperature can be 25° C. or higher. As a precondition, the relative humidity can be less than 100%. With respect to the humidification conditions, the atmosphere can have a temperature of 25° C. or higher to 35° C. or lower and an absolute humidity of 0.017 kg/kgDA or higher. In this case, the effect of improving the intermittent ejection stability by humidification is high, and the relative humidity is less than 100% in this temperature range. Thus, no condensation occurs on the recording head, providing excellent ejection stability.

Aspects of the present invention, in addition to the humidification step described above, a prehumidification step of humidifying a recording medium can be performed before the image formation step. In this step, the recording medium is humidified before the recording medium is conveyed to an image forming portion including the recording head. The intermittent ejection stability is more effectively improved by performing this prehumidification step. The reason for this is as follows: The prehumidification step allows the recording medium to sufficiently absorb water before the recording medium is conveyed to the image forming portion. This makes it possible to effectively humidify the gap between the recording head and the recording medium. In aspects of the present invention, the prehumidification step is performed by supplying humidified air before the recording medium is conveyed to the image forming portion including the recording head. The prehumidification step can be performed in an atmosphere having a temperature of 35° C. or lower and an absolute humidity of 0.013 kg/kgDA or higher.

Ink Jet Recording Apparatus

An ink jet recording apparatus according to aspects of the present invention includes an ink storage portion configured to store an ink, an image forming portion configured to form an image on a recording medium having an ink-receiving layer by ejecting an ink from an ink jet recording head, and a unit configured to humidify a gap between the recording head and the recording medium, in which the ink stored in the ink storage portion is the ink described above.

The structure of the ink jet recording apparatus according to aspects of the present invention will be described below. FIGURE is a schematic diagram of an exemplary image forming portion 1 of the ink jet recording apparatus used in the ink jet recording method according to aspects of the present invention. The illustration of the entire structure of the recording apparatus is omitted. A paper feeding unit, the image forming portion 1, a cutting unit, a drying unit, the ink storage portions, a control unit, and a paper ejecting section are arranged from the upstream side to the downstream side of the conveying direction of the recording medium. The paper feeding unit rotatably holds a recording medium 2 wound in the form of a roll. The image forming portion 1 includes a plurality of recording heads 1*a* corresponding to inks of different colors. Here, four recording heads corresponding to the four inks are arranged. However, the number of inks is not limited to four. Each of the inks is fed from the ink storage portions to a corresponding one of the recording heads 1*a* through ink tubes. Each of the plural recording heads 1*a* is a line-type recording head provided with an ink jet nozzle array that covers the maximum width of the recording medium to be used.

In the image forming portion 1, a recording medium conveying path is arranged transversely and faces the recording heads 1*a*. A conveying mechanism configured to convey the recording medium is arranged along the recording medium conveying path. The plural recording heads 1*a* and the conveying mechanism are arranged in a substantially enclosed space in a housing 1*b*. A second humidifying unit 1*d* configured to humidify the gap between the recording heads 1*a* and the recording medium is arranged in the image forming portion 1 and supplies humidified air into the gap between the recording heads 1*a* and the recording medium (i.e., paper-head distance). The humidified air may be fed not only into the gap between the recording heads 1*a* and the recording medium but also into the whole of the substantially enclosed space in the housing 1*b* to fill the whole of the space with an atmosphere that satisfies predetermined temperature and humidity conditions. Furthermore, a first humidifying unit 1*c* configured to preliminarily humidify the recording medium before the recording medium is conveyed to the image forming portion including the recording heads may be arranged on the upstream side of the recording heads 1*a* in the conveying direction.

The cutting unit is configured to cut the recording medium, on which an image has been formed at the image forming portion 1, into a predetermined size. The cutter unit includes a cutting mechanism. The drying unit is configured to dry the cut recording medium in a short time. The drying unit includes a hot-blast device provided with a heater configured to heat a gas and a fan configured to generate the flow of the heated gas, and a plurality of conveying rollers arranged along the recording medium conveying path. The paper ejecting section is configured to accommodate the cut recording medium ejected from the drying unit. A plurality of pieces of the recording medium are stacked therein. The control unit serves as a controller responsible for controlling and driving the entire recording apparatus.

Note that the predetermined temperature and humidity conditions described above can be achieved without performing the humidification step, depending on an environment where the ink jet recording apparatus is placed. However, the temperature and humidity in the outside environment are always changed. So, the predetermined temperature and humidity conditions are not always satisfied. Accordingly, the achievement of the temperature and humidity conditions, which are set in the aspects of the present invention, by performing the humidification step remains effective in providing the advantages of aspects of the present invention.

EXAMPLES

While the present invention will be described in more detail below by way of Examples and Comparative Examples, the present invention is not limited to the following Examples.

Preparation of Ink

Components (unit: % by mass) shown in Table 2 described below were mixed and sufficiently stirred to dissolve the components. The resulting solutions were filtered under pressure with a microfilter (manufactured by Fujifilm Corporation) having a pore size of 0.2 μm to prepare inks. Table 2 also shows the content A (% by mass) of the dye of general formula (I) in the ink, the content B (% by mass) of the water-soluble organic compound having an IOB value of 1.4 or more to 2.7 or less, and B/A (times). Note that for the water-soluble organic compounds, each of the numbers in parentheses represents the IOB value.

Acetylenol E100 is a nonionic surfactant manufactured by Kawaken Fine Chemicals Co., Ltd. As exemplified compounds I-1 and I-10, compounds synthesized on the basis of Examples described in International Publication No. WO2007/091631 were used. Note that dyes of general formula (I) are all mixtures. The mixtures of isomers and so forth are referred to as "dyes". That is, the dyes include, for example, regioisomers of compounds, regioisomers in terms of the position of the nitrogen atom in a pyridine ring, isomers having different ratios of benzo rings to nitrogen-containing heteroaromatic rings represented by A, B, C and D in general formula (I), and α/β regioisomers of a substituted or unsubstituted sulfamoyl group in a benzo ring. A comparative compound was a dye having a structure in which ring A in exemplified compound I-1 represents a benzene ring. As the comparative compound, a compound synthesized on the basis of Examples described in International Publication No. WO2004/087815 was used.

TABLE 2

Composition and main properties of ink

| | Ink No. | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Exemplified compound I-1 | 1.0 | | 1.0 | 1.0 | 0.5 | 0.7 | 2.0 | 2.2 | 1.0 | 1.0 | 1.0 | 1.0 | | 1.0 | 1.0 |
| Exemplified compound I-10 | | 1.0 | | | | | | | | | | | | | |
| Comparative compound | | | | | | | | | | | | | 1.0 | | |
| Glycerol (5.0) | 5.0 | 5.0 | 5.0 | 5.0 | 5.0 | 5.0 | 5.0 | 5.0 | 5.0 | 5.0 | 5.0 | 5.0 | 5.0 | 5.0 | 5.0 |
| Ethylene urea (3.6) | | | 10.0 | | | | | | | | | | | 10.0 | |
| Bis (2-hydroxyethyl) sulfone (3.1) | 10.0 | 10.0 | | 10.0 | 10.0 | 10.0 | 10.0 | 10.0 | 10.0 | 10.0 | 10.0 | 10.0 | 10.0 | 10.0 | 10.0 |
| Triethylene glycol (2.7) | | | | | | | | | 10.0 | | | | | | |
| 1,4-Butanediol (2.5) | | | | 5.0 | | | | | | 10.0 | | | | | |
| 1,5-Pentanediol (2.0) | 10.0 | 10.0 | 10.0 | 5.0 | 10.0 | 10.0 | 10.0 | 10.0 | | | | | 10.0 | | |
| 1,2-Hexanediol (1.7) | | | | | | | | | | | 10.0 | | | | |
| Triethylene glycol monobutyl ether (1.4) | | | | | | | | | | | | 10.0 | | | |
| 1-Butanol (1.3) | | | | | | | | | | | | | | | 10.0 |
| Acetylenol E100 | 0.4 | 0.4 | 0.4 | 0.4 | 0.4 | 0.4 | 0.4 | 0.4 | 0.4 | 0.4 | 0.4 | 0.4 | 0.4 | 0.4 | 0.4 |
| Deionized water | 73.6 | 73.6 | 73.6 | 73.6 | 74.1 | 73.9 | 72.6 | 72.4 | 73.6 | 73.6 | 73.6 | 73.6 | 73.6 | 73.6 | 73.6 |
| A (% by mass) | 1.0 | 1.0 | 1.0 | 1.0 | 0.5 | 0.7 | 2.0 | 2.2 | 1.0 | 1.0 | 1.0 | 1.0 | 0.0 | 1.0 | 1.0 |
| B (% by mass) | 10.0 | 10.0 | 10.0 | 10.0 | 10.0 | 10.0 | 10.0 | 10.0 | 10.0 | 10.0 | 10.0 | 10.0 | 10.0 | 0.0 | 0.0 |
| B/A [times] | 10.0 | 10.0 | 10.0 | 10.0 | 20.0 | 14.3 | 5.0 | 4.5 | 10.0 | 10.0 | 10.0 | 10.0 | — | 0.0 | 0.0 |

Evaluation

Ruled line patterns having a line width of about 0.44 mm were formed on recording media (trade names: PT-101, SG-201, GL-101, and GF-500, manufactured by CANON KABUSHIKI KAISHA) shown in Table 3 using inks shown in Table 3 at a recording duty of 150%. During the formation of each of the patterns, humidified air was fed in such a manner that an atmosphere between a recording head and the recording medium had a temperature and an absolute humidity shown in Table 3. For comparison, the same ruled line patterns were formed at a temperature of 23° C., a relative humidity of 50% (an absolute humidity of 0.009 kg/kgDA) without humidification.

The recording media used were Canon Photo Paper Pro Platinum Gloss PT-101, Canon Photo Paper Semi-gloss SG-201, Canon Photo Paper Gloss gold GL-101, and PB PAPER GF-500 (all manufactured by CANON KABUSHIKI KAISHA). In Table 3, these recording media are expressed as PT-101, SG-201, GL-101, and GF-500. Here, PT-101, SG-201, and GL-101 are recording media each including an ink-receiving layer. The ink-receiving layer of PT-101 contains hydrated alumina. The ink-receiving layers of SG-201 and GL-101 each contain silica. Note that GF-500 does not include an ink-receiving layer and what is called plain paper.

An ink jet recording apparatus was used which included the image forming portion illustrated in FIGURE. Specifically, the apparatus included a recording head configured to eject ink by the application of thermal energy, and a humidifying unit (second humidifying unit in FIGURE) configured to supply humidified air into a gap between a recording head and a recording medium at the time of image formation. Recording conditions were set as follows: volume per ink droplet: 2.8 pL, and resolution: 2400 dpi×1200 dpi. In aspects of the present invention, an image formed under conditions in which eight ink droplets each having a volume of 2.8 pL were applied to a 1/600 inch×1/600 inch unit region was defined as an image with a recording duty of 100%. Then, the image was allowed to stand at a temperature of 23° C. and a relative humidity of 50% for 24 hours to provide an evaluation sample.

For the resulting evaluation samples, raggedness value $Ra_1$ when humidification was performed and raggedness value $Ra_2$ when humidification was not performed were measured. The raggedness values were measured with a personal image quality evaluation system (trade name: Personal IAS, manufactured by Quality Engineering Associates). Then the value of ΔRa was determined from $\Delta Ra = Ra_1 - Ra_2$, thereby evaluating the suppression of feathering by humidification. Furthermore, the degree of feathering was evaluated on the basis of the value of $Ra_1$. In aspects of the present invention, the variation degree of the line width of the ruled line was measured with the evaluation system described above. When the raggedness value is small, the line width of the ruled line is constant, which is excellent. Evaluation criteria were described below. Table 3 shows the results. In aspects of the present invention, according to the following evaluation criteria, in the case where ΔRa was classified into grade C or higher and where $Ra_1$ was classified into grade C or higher, the feathering was defined as an acceptable level. In the case where at least one of ΔRa and $Ra_1$ was classified into grade D, the feathering was defined as an unacceptable level.

Evaluation Criteria of Suppression of Feathering by Humidification

A: ΔRa was −0.10 or less.

B: ΔRa was more than −0.10 and −0.05 or less.

C: ΔRa was more than −0.05 and 0.00 or less.

D: ΔRa was more than 0.00.

Evaluation Criteria of Degree of Feathering

A: $Ra_1$ was 1.60 or less.

B: $Ra_1$ was more than 1.60 and 1.70 or less.

C: $Ra_1$ was more than 1.70 and 1.80 or less.

D: $Ra_1$ was more than 1.80.

TABLE 3

Evaluation conditions and evaluation results

| | | Evaluation conditions | | | | Evaluation results | | | | |
|---|---|---|---|---|---|---|---|---|---|---|
| | | Ink No. | Type of recording medium | Humidification temperature [° C.] | Absolute humidity [kg/kg DA] | $Ra_2$ (not humidified) | $Ra_1$ (humidified) | ΔRa | Suppression of feathering by humidification | Degree of feathering |
| Example | 1 | 1 | PT101 | 35 | 0.015 | 1.68 | 1.53 | −0.15 | A | A |
| | 2 | 2 | PT101 | 35 | 0.015 | 1.69 | 1.55 | −0.14 | A | A |
| | 3 | 3 | PT101 | 35 | 0.015 | 1.57 | 1.41 | −0.17 | A | A |
| | 4 | 4 | PT101 | 35 | 0.015 | 1.64 | 1.55 | −0.09 | B | A |
| | 5 | 5 | PT101 | 35 | 0.015 | 1.86 | 1.82 | −0.04 | C | C |
| | 6 | 6 | PT101 | 35 | 0.015 | 1.86 | 1.80 | −0.06 | B | C |
| | 7 | 7 | PT101 | 35 | 0.015 | 1.75 | 1.69 | −0.06 | B | B |
| | 8 | 8 | PT101 | 35 | 0.015 | 1.75 | 1.71 | −0.04 | C | C |
| | 9 | 9 | PT101 | 35 | 0.015 | 1.75 | 1.71 | −0.04 | C | C |
| | 10 | 10 | PT101 | 35 | 0.015 | 1.76 | 1.67 | −0.09 | B | B |
| | 11 | 11 | PT101 | 35 | 0.015 | 1.66 | 1.65 | −0.01 | C | B |
| | 12 | 12 | PT101 | 35 | 0.015 | 1.71 | 1.71 | 0.00 | C | C |
| | 13 | 1 | PT101 | 40 | 0.015 | 1.68 | 1.65 | −0.03 | C | B |
| | 14 | 1 | PT101 | 35 | 0.010 | 1.68 | 1.65 | −0.03 | C | B |
| | 15 | 1 | PT101 | 35 | 0.013 | 1.68 | 1.59 | −0.09 | B | A |
| | 16 | 1 | SG201 | 35 | 0.015 | 1.64 | 1.56 | −0.08 | B | A |
| | 17 | 1 | GL101 | 35 | 0.015 | 1.65 | 1.56 | −0.09 | B | A |
| Reference Example | 1 | 1 | GF500 | 35 | 0.015 | 29.77 | 29.19 | −0.58 | — | — |
| Comparative Example | 1 | 13 | PT101 | 35 | 0.015 | 1.60 | 1.71 | 0.11 | D | C |
| | 2 | 14 | PT101 | 35 | 0.015 | 1.43 | 1.80 | 0.37 | D | D |
| | 3 | 15 | PT101 | 35 | 0.015 | 1.73 | 1.75 | 0.02 | D | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-141940 filed Jun. 22, 2010, which is hereby incorporated by reference herein in its entirety.

What is claimed is:

1. An ink jet recording method comprising:

an image formation step of forming an image on a recording medium having an ink-receiving layer by ejecting an ink from an ink jet recording head; and a humidification step of humidifying a gap between the recording head and the recording medium, wherein in the image formation step, an ink containing a dye represented by general formula (I) and a water-soluble organic compound having an inorganic-organic balance value of 1.4 or more to 2.7 or less is used:

general formula (I)

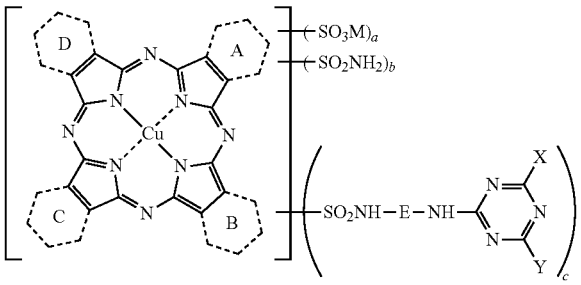

wherein in general formula (I), A, B, C, and D each independently represent a six-membered ring having aromaticity, and at least one of A, B, C, and D represents a pyridine ring or a pyrazine ring; M's each independently represent a hydrogen atom, an alkali metal, ammonium, or organic ammonium; E represents an alkylene group; X represents a sulfo-substituted anilino group, a carboxy-substituted anilino group, or a phosphono-substituted anilino group, and the substituted anilino group may further contain one to four substituents of at least one type of substituent selected from the group consisting of a sulfonic acid group, a carboxy group, a phosphono group, a sulfamoyl group, a carbamoyl group, a hydroxy group, an alkoxy group, an amino group, an alkylamino group, a dialkylamino group, an arylamino group, a diarylamino group, an acetylamino group, an ureido group, an alkyl group, a nitro group, a cyano group, a halogen atom, an alkylsulfonyl group, and an alkylthio group; Y represents a hydroxy group or an amino group; and a, b, and c satisfy $0 \le a \le 2.0$, $0 \le b \le 3.0$, and $0.1 \le c \le 3.0$, provided that $a+b+c=1.0$ to 4.0, wherein the humidification step is performed by supplying humidified air into the gap between the recording head and the recording medium, and wherein the gap between the recording head and the recording medium is filled with an atmosphere having a temperature of 35° C. or lower and an absolute humidity of 0.013 kg/kgDA or higher.

2. The ink jet recording method according to claim 1, wherein the content (% by mass) of the dye represented by general formula (I) in the ink is in the range of 0.7% by mass or more to 2.0% by mass or less with respect to the total mass of the ink, and wherein the mass ratio of the content (% by mass) of the water-soluble organic compound with respect to the total mass of the ink to the content (% by mass) of the dye represented by general formula (I) is in the range of 5.0 times or more to 14.3 times or less.

3. The ink jet recording method according to claim 1, wherein the water-soluble organic compound in the ink has an inorganic-organic balance value of 1.7 or more to 2.5 or less.

4. The ink jet recording method according to claim 1, wherein the ink contains 1,5-pentanediol serving as the water-soluble organic compound having an inorganic-organic balance value of 1.4 or more to 2.7 or less.

5. The ink jet recording method according to claim 1, wherein the absolute humidity is 0.015 kg/kgDA or higher.

6. The ink jet recording method according to claim 1, wherein the water-soluble organic compound having an inorganic-organic balance value of 1.4 or more to 2.7 or less is at least one selected from the group consisting of triethylene glycol, 1,4-butanediol, 1,5-pentanediol, 3-methyl-1,5-pentanediol, 1,2-hexanediol, 1,6-hexanediol, triethylene glycol monobutyl ether and 2-pyrrolidone.

7. An ink jet recording apparatus comprising:

an ink storage portion configured to store an ink;

an image forming portion configured to form an image on a recording medium having an ink-receiving layer by ejecting an ink from an ink jet recording head; and a unit configured to humidify a gap between the recording head and the recording medium by supplying humidified air into the gap so that the gap is filled with an atmosphere having a temperature of 35° C. or lower and an absolute humidity of 0.013 kg/kgDA or higher, wherein the ink stored in the ink storage portion contains a dye represented by general formula (I) and a water-soluble organic compound having an inorganic-organic balance value of 1.4 or more to 2.7 or less:

general formula (I)

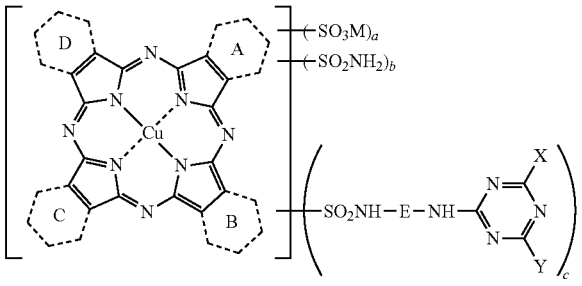

wherein in general formula (I), A, B, C, and D each independently represent a six-membered ring having aromaticity, and at least one of A, B, C, and D represents a pyridine ring or a pyrazine ring; M's each independently represent a hydrogen atom, an alkali metal, ammonium, or organic ammonium; E represents an alkylene group; X represents a sulfo-substituted anilino group, a carboxy-substituted anilino group, or a phosphono-substituted anilino group, and the substituted anilino group may further contain one to four substituents of at least one type of substituent selected from the group consisting of a sulfonic acid group, a carboxy group, a phosphono group, a sulfamoyl group, a carbamoyl group, a hydroxy group, an alkoxy group, an amino group, an alkylamino group, a dialkylamino group, an arylamino group, a diarylamino group, an acetylamino group, an ureido group, an alkyl group, a nitro group, a cyano group, a halogen atom, an alkylsulfonyl group, and an alkylthio group; Y represents a hydroxy group or an amino group; and a, b, and c satisfy $0 \le a \le 2.0$, $0 \le b \le 3.0$, and $0.1 \le c \le 3.0$, provided that $a+b+c=1.0$ to 4.0.

* * * * *